US007164417B2

(12) United States Patent
Cok

(10) Patent No.: US 7,164,417 B2
(45) Date of Patent: Jan. 16, 2007

(54) DYNAMIC CONTROLLER FOR ACTIVE-MATRIX DISPLAYS

(75) Inventor: Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 518 days.

(21) Appl. No.: 09/817,547

(22) Filed: Mar. 26, 2001

(65) Prior Publication Data

US 2002/0175885 A1 Nov. 28, 2002

(51) Int. Cl.
*G09G 5/00* (2006.01)

(52) U.S. Cl. ..... 345/207; 315/169.3; 348/181

(58) Field of Classification Search ..... 345/211, 345/30, 39, 60, 61, 48, 51, 45, 46, 63, 76, 345/77, 80, 82, 83–84, 55, 204, 207; 315/169.1, 315/169.3, 169.4, 169.2; 348/180, 181
See application file for complete search history.

(56) References Cited

U.S. PATENT DOCUMENTS 4,386,345 A * 5/1983 Narveson et al. ..... 345/22
5,047,861 A * 9/1991 Houchin et al. ..... 348/247
6,081,073 A * 6/2000 Salam ..... 315/169.2
6,097,360 A * 8/2000 Holloman ..... 345/84
6,100,879 A 8/2000 Da Costa
6,414,661 B1 * 7/2002 Shen et al. ..... 345/82

OTHER PUBLICATIONS

U.S. Appl. No. 09/577,241, filed May 24, 2000 by Cok, et al.
U.S. Appl. No. 09/675,346, filed Sep. 29, 2000 by Cok et al.
U.S. Appl. No. 09/707,223, filed Nov. 6, 2000 by Cok et al.

* cited by examiner

*Primary Examiner*—Kent Chang
(74) *Attorney, Agent, or Firm*—Andrew J. Anderson; Thomas H. Close

(57) ABSTRACT

A dynamic controller for a light emitting active-matrix display, the display being responsive to code values for producing a light output, including: photosensor located on the display for sensing the light output from the display and generating a feedback signal representative thereof; a feedback signal converter for converting the feedback signal to a converted feedback signal having the same form as the code value; a code-value corrector including a memory responsive to a code value for producing a corrected code value; and an update calculator responsive to the converted feedback signal, the code value and the corrected code value to update the memory to minimize the difference between the converted feedback signal and the code value.

19 Claims, 1 Drawing Sheet

DYNAMIC CONTROLLER FOR ACTIVE-MATRIX DISPLAYS

FIELD OF THE INVENTION

The present invention relates to an improved method for controlling active-matrix displays, in particular, a method employing feedback signals to correct input data and improve the display quality.

BACKGROUND OF THE INVENTION

Active-matrix light emitting displays include drive electronics associated with each light emitting pixel for controlling the light output of the pixels. Active-matrix emissive display devices suffer from a number of difficulties. For example, as the emissive materials in the light emitters age, the materials change so that the light output from the light emitters will also change. In addition, it is problematic to manufacture such display devices and maintain a consistent uniformity across the entire display due to process control difficulties. Moreover, the materials employed in active-matrix emissive display devices change from one generation to the next, and the cost of creating a custom controller for each generation of material add significantly to the cost of the display devices.

The use of smart controllers capable of controlling a variety of similar devices and incorporating programmable elements is known. For example, U.S. Pat. No. 6,100,879 issued Aug. 8, 2000 to DaCosta discloses a system for controlling an active-matrix display using a smart controller with a programmable register on board. The approach proposed by DaCosta does not compensate for changes in the light output of the display over time, thus the problems noted above still exist.

There is a need, therefore, for a controller that overcomes the problems noted above.

SUMMARY OF THE INVENTION

This need is met according to the present invention by providing a dynamic controller for a light emitting active-matrix display, the display being responsive to code values for producing a light output, that includes: photosensor located on the display for sensing the light output from the display and generating a feedback signal representative thereof; a feedback signal converter for converting the feedback signal to a converted feedback signal having the same form as the code value; a code-value corrector including a memory responsive to a code value for producing a corrected code value; and an update calculator responsive to the converted feedback signal, the code value and the corrected code value to update the memory to minimize the difference between the converted feedback signal and the code value.

ADVANTAGES

Because the present invention relies upon feedback and correction rather than a model of the active-matrix device behavior, it can be applied with few or no changes to a wide variety of devices. For example, if the light-emitting materials change or device-to-device variability is significant, no change to the design is necessary and the present invention will properly correct for any changes or variability.

The present invention provides a simple design for accommodating optical feedback from active-matrix display devices. It is suitable for feedback from individual pixels, sub-pixel elements, or from representative pixels or elements. The present invention is easy to implement and control and provides dynamic correction as each data value is written. Using conventional means, the converter device can be controlled from a computer, external memory, or programmable read-only-memory. The basic design can be either analog or digital and can readily accommodate a variety of feedback signal types.

DETAILED DESCRIPTION OF THE INVENTION

The present invention is a system for the correction of image pixel output in an active-matrix, emissive display. The system relies upon a feedback signal generated by a sensor on the display device. This feedback signal is used to adjust the display output. The controller of the present invention is referred to as a dynamic controller because the adjustments applied by the controller change over time as the characteristics of the display device change.

Figure 1:
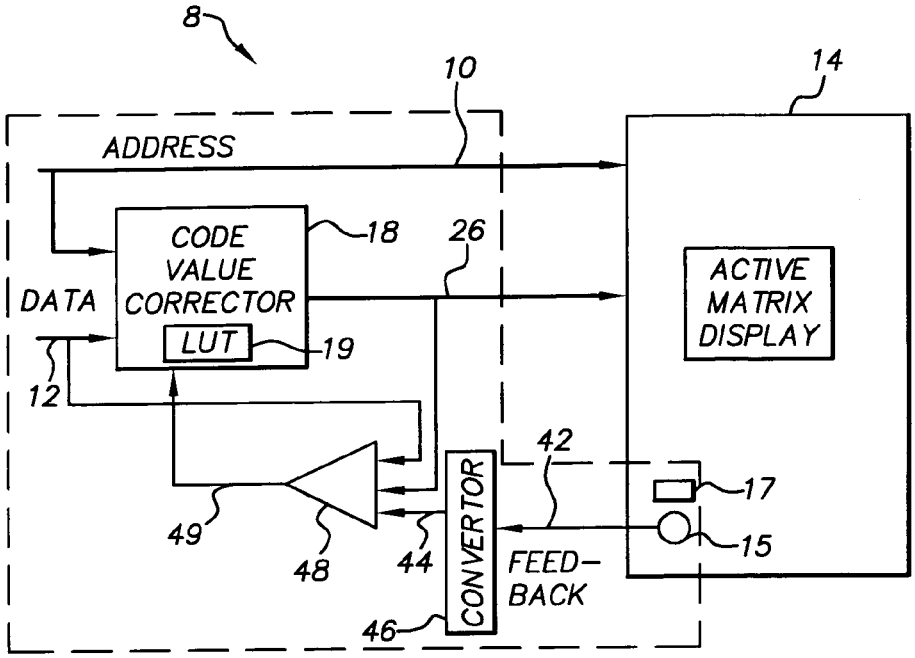
FIG. 1 is a diagram of an active-matrix display having a dynamic controller according to the present invention.

A dynamic active-matrix controller 8 according to the present invention is shown in FIG. 1. Referring to FIG. 1, conventional address and data lines 10 and 12 are used to address the individual light emitting elements that make up the pixels in an active-matrix display 14 to specify the amount of light to be emitted by each pixel, respectively. For a color display, the address lines 10 can address color subpixels in each pixel separately or together. The data signals are encoded as code values which specify the level of light output desired from the pixels. According to the present invention, the code values are corrected to accommodate changes in the output characteristics of the display device using a code-value corrector 18. The corrected code values 26 are presented to the active-matrix display device 14 which emits light in response. The light output from the display device is detected by a photosensor 15 to provide a feedback signal 42. This feedback signal 42 is converted by a feedback signal converter 46 to a converted feedback signal 44 having the same form as the code value data signals 12. An update calculator 48 combines the code value data signals 12, the converted feedback signal 44 and the corrected code value 26 to create an updated corrected code value 49. This updated corrected code value 49 is supplied to and stored in the code-value corrector 18.

The controller 8 can include one or more photosensors 15 that can be associated with individual light emitting elements, with groups of elements, or with representative light emitting elements 17 that are provided on the display, but are not visible as a part of the display. The code-value corrector 18 includes a memory containing a lookup table 19 for each photosensor 15. The lookup tables are selected according to the addresses of the pixels associated with the photosensors. Thus, if a single representative pixel is used, only one lookup table is required and all pixel addresses will be referred to the table. If the photosensors are associated with groups of pixels, the pixel addresses for the group will be referred to the corresponding lookup table. In the event that a photosensor 15 is provided for each pixel, there will be a corresponding lookup table for each pixel. Alternatively, the lookup tables 19 can contain one or more correction parameters and the corrected code values be computed using the correction parameters. This approach trades off speed and memory size for complexity.

If a photosensor 15 is provided for each light emitting element in the display, the present invention can be used to fully correct for any spatial nonuniformities in the display device. Where photosensors 15 are provided for groups of pixels, identical corrections are made for each light emitting element within the group, thereby limiting the amount of nonuniformity correction that can be performed. With the use of only one photosensor 15, for example with a representative light emitting element 17, nonuniformities across a display will not be addressed. Photosensors can be employed with representative pixels of each color in a color display, to compensate for color changes such as those resulting from aging. The controller 8 can include means for sending every code value to the representative pixel and producing a corrected code value for every code value.

The code values presented to the controller 8 are typically a digital value from zero to 256 and represent the amount of light to be emitted by the light emitting element at the associated address. The feedback signal 42, in contrast, may be a current. This current represents the amount of light output by a light emitting element in the display. The conversion from the current measured and the light output is performed by applying calibration information initially obtained from a measurement of the light and related current in an ideal device. This current information is obtained for each light output level and used to calibrate the feedback signal converter 46.

Once the converted feedback signal 44 is generated, it is used to update the code-value corrector 18. The difference between the converted feedback signal 44 and the desired code value data signals 12 is calculated. This difference is then combined with the corrected code value 26 to create a new, updated corrected code value 49. This updated corrected code value 49 is stored in the code-value corrector 18 and used to correct subsequent code values. The calculator and the code-value corrector may be integrated into a single integrated circuit or provided by discrete components.

Various arrangements for providing sensors on a display device are shown in more detail in copending U.S. patent application Ser. No. 09/577,241 filed May 24, 2000 by Cok et al.; U.S. Patent application Ser. No. 09/675,346 filed Sep. 29, 2000 by Cok et al.; and U.S. patent application Ser. No. 09/707,223 filed Nov. 6, 2000 by Cok et al., which are incorporated herein by reference.

Figure 2:
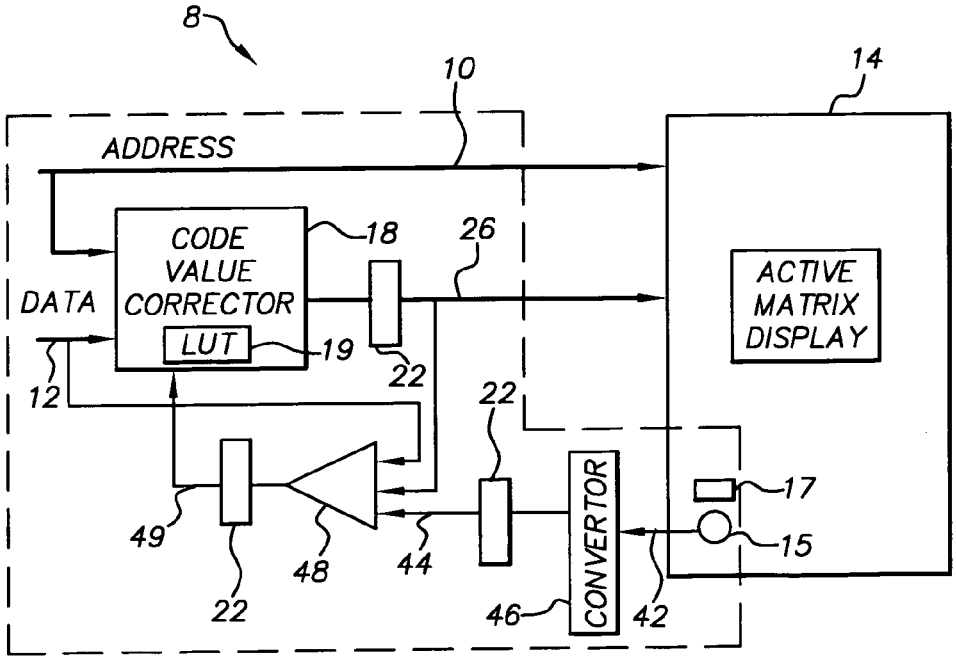
FIG. 2 is a diagram of an active-matrix display having a dynamic controller having additional intermediate storage device options.

In a practical embodiment of the present invention, additional timing, storage, and control signals may be used to increase signal availability, reliability, timeliness, and the like. For example, in the embodiment shown in FIG. 2, additional, intermediate storage devices 22 are provided for receiving and storing corrected data signals from the data signal corrector and supplying the corrected data signals to the display, for receiving converted feedback signals 44 and supplying them to the update calculator 48, or for receiving update signals 49 and supplying them to the code-value corrector 18. Any one or all of these storage devices may be used to facilitate system timing.

Once the code values have been corrected and the device has properly loaded the corrected factor into the code-value corrector 18, the next time that the particular data signal occurs at that pixel location, the new, corrected code value will be applied and the display device will emit the desired amount of light in response to the corrected code value. When the comparison between the desired code value data signals 12 and the converted feedback value 44 goes to zero, the same value 26 is re-entered into the code-value corrector 18 and no change is made. Note that the code-value corrector 18 does not have to be pre-loaded and does not require a complex model of the behavior of the display device. The feedback circuit will adjust the contents of lookup table 19 over time to correct for changes in the display device.

In a preferred implementation, feedback from each pixel is obtained as the address and data values are applied. This avoids complex logic which would otherwise be necessary to intermingle the writing of corrected code value 49 into the code-value corrector 18 with the read-out of corrected signals 26 from the code-value corrector 18.

It is also possible to implement the present invention as a start-up or initial calibration mechanism for a display. While this approach does not provide real-time feedback and correction, it may simplify the requirements for the system. In this embodiment, the various pixel elements from which feedback is obtained are completely exercised with all possible values, the feedback obtained, an update signal generated, and the code-value corrector updated for each value before the device enters normal operation. Once the code-value corrector is updated with the correct values, the device operates as normal but without any on-going feedback or correction.

In a preferred implementation, the code-value corrector 18 is made of conventional lookup tables. Likewise, the feedback converter is made of conventional lookup tables with an analog to digital voltage converter and/or current/voltage converters. The update calculator 48 can be implemented with conventional digital logic or analog operational amplifiers.

The code-value corrector 18 is capable of storing every possible output value for every possible pixel sub-element for which feedback is generated. In the ideal case, the feedback is generated from every sub-pixel element, thus requiring a separate value for each possible output level for each sub-pixel element which is readily implemented with modem integrated circuit technology. The size of the memory will scale with the size of the display and number of display elements. In the case that a single representative pixel is used for each of three colors, only three 8-bit tables are necessary. It may also be preferable to use a separate feedback signal for each color (particularly if representative pixels are used) together with separate conversion, calculation, and correction devices. This is a matter of circuit design structure and is well-known in the art.

The feedback signal converter 46 contains the information necessary to translate the feedback signal to the desired data value associated with that signal. Therefore a correspondence between each color value and a feedback value is maintained. For a representative pixel or for feedback that is only dependent on the color of the sub-pixel element, a three-color, 8-bit active-matrix display with a very small table containing only 768 bytes is used. If feedback is obtained from each pixel, the present invention can be used to correct for uniformity problems as well as aging of materials and ambient conditions.

Moreover, if global image corrections based on pixel positions are desired, the conversion calculation could include a dependency on pixel position, which is easily implemented by applying the address signals to the converter. This is useful, for example, if the active-matrix display is a part of a larger optical system for which pixel-position compensation is desired. In this case, a larger table like that of the code-value corrector 18 will be needed.

It is also possible to provide a global correction to the display based on other attributes such as the ambient illumination by modifying the feedback signal to accommodate an ambient signal, for example by increasing or decreasing the feedback value for all pixels by an amount representative of the ambient.

If the frequency at which data is written to the active-matrix display device 14 exceeds the capability of the materials in the device to propagate signals, the display device is separated into separate, smaller sections driven in parallel, as is well known in the art. Each section then has a different feedback and correction circuit. If representative pixels are used, a separate representative pixel supplies the feedback from each section. If the device is separated into separate, smaller sections, the storage requirements for the code-value corrector 18 are reduced accordingly. If the number of feedback elements is reduced, the size of the feedback signal converter 46 will likewise be reduced. Hence the invention will scale reasonably well to large display sizes.

The present invention does not require a complex model of the pixel behavior under various conditions, simply a target or desired output matched to the code value data signals 12, together with initial calibration data. Because the present invention relies upon feedback and correction rather than a model of the active-matrix device 14 behavior, it can be applied with few or no changes to a wide variety of devices. For example, if the light-emitting materials change or device-to-device variability is significant, no change to the design is necessary and the present invention will properly correct for any changes or variability.

The active-matrix address and data signals need not be digital. By supplying a digital to analog signal converter to convert the data and/or address control signals, an analog interface can be implemented.

Most active-matrix display devices require some color transformation to adjust the color and contrast ranges of the display. These transformations should generally be done before the signals reach the code-value corrector 18. Although the code-value corrector 18 can be designed to implement these transformations as well, the code-value corrector becomes much more complex especially, for example, if color matrix transforms are required.

Although the Figures illustrate a design in which the feedback converter, comparator, corrections device, and data store are all separate from the display, it is possible to integrate any or all of these components on a common substrate with the display device itself.

The invention has been described in detail with particular reference to certain preferred embodiments thereof, but it will be understood that variations and modifications can be effected within the spirit and scope of the invention.

| PARTS LIST | |
|---|---|
| 8 | dynamic controller |
| 10 | address signals |
| 12 | code value data signals |
| 14 | active-matrix display device |
| 15 | photosensor |
| 17 | representative light emitting element |
| 18 | code-value corrector |
| 19 | lookup table |
| 22 | local storage device |
| 26 | corrected code values |
| 42 | feedback signal |
| 44 | converted feedback signal |

-continued

| PARTS LIST | |
|---|---|
| 46 | feedback signal converter |
| 48 | update calculator |
| 49 | corrected code value |

What is claimed is:

1. A dynamic controller for a light emitting active-matrix display, the display being responsive to code values for producing a light output, comprising:

a) a photosensor located on the display for sensing the light output from the display in response to desired code values and generating a feedback signal representative thereof;

b) a feedback signal converter for converting the feedback signal to a converted feedback signal having the same form as the desired code values;

c) a code-value corrector including a memory responsive to a desired code value for producing a corrected code value; and d) an update calculator for creating an updated corrected code value by combining the difference between the converted feedback signal and the desired code values with the corrected code value, and storing the updated corrected code value in the memory.

2. The controller claimed in claim 1, further comprising an intermediate memory for receiving and storing corrected data signals from the data signal corrector and supplying the corrected data signals to the display.

3. The controller claimed in claim 1, further comprising an intermediate memory for receiving and storing converted feedback signals from the feedback signal converter and supplying the converted feedback signals to the correction signal calculator.

4. The controller claimed in claim 1, wherein the feedback signal is an analog current signal and the converted feedback signal is a digital code value.

5. The controller claimed in claim 1, wherein the code values are supplied to the display device as analog signals, and further comprising a digital to analog converter for converting the digital signals to analog signals prior to applying the code value signals to the display device.

6. The controller claimed in claim 1, wherein the code values are supplied to the display as digital signals.

7. The controller claimed in claim 1, wherein the active-matrix display includes display pixels and a photosensor for each display pixel.

8. The controller claimed in claim 1, wherein the active-matrix display includes representative pixels and a photosensor for each representative pixel.

9. The controller claimed in claim 8, further comprising means for sending every code value to the representative pixel and producing a corrected code value for every code value.

10. The controller claimed in claim 1, wherein the display and the dynamic controller are partitioned into multiple units.

11. The controller claimed in claim 1, wherein the display device is a color display device and the dynamic controller includes a representative pixel and a photosensor for each color.

12. The controller claimed in claim 11, including a separate feedback signal converter, code-value corrector, and update calculator for each color.

13. The controller claimed in claim 1, wherein the display is a color display and the code-value corrector includes means for performing color transformations on the code values.

14. The controller claimed in claim 1, further comprising means for compensating the converted feedback signal for a global display attribute.

15. The controller claimed in claim 14, wherein the global display attribute is ambient illumination.

16. The controller claimed in claim 1, wherein the feedback signal converter includes circuitry to compensate for pixel-specific display attributes.

17. The controller claimed in claim 1, wherein the feedback signal converter includes circuitry to compensate for position-specific display attributes.

18. The controller claimed in claim 1, including means for updating the memory upon start-up.

19. The controller claimed in claim 1, wherein the controller and the display device are integrated on a common substrate.

* * * * *